US005402575A

United States Patent [19]

Maxcy

[11] Patent Number: 5,402,575

[45] Date of Patent: Apr. 4, 1995

[54] FOLDING KNIFE PROVIDED WITH AN ACCESSORY

[76] Inventor: Richard B. Maxcy, 214 Eastern Rd., Warren, Me. 04864

[21] Appl. No.: 247,871

[22] Filed: May 23, 1994

[51] Int. Cl.[6] ..... B25F 3/00

[52] U.S. Cl. ..... 30/123; 7/158; 362/119

[58] Field of Search ..... 30/123, 142, 143, 151, 30/153, 155, 157; 362/119, 120; 7/119, 167, 168, 158

[56] References Cited

U.S. PATENT DOCUMENTS

| | | | |
|---|---|---|---|
| 4,364,174 | 12/1982 | De Asis | 30/153 |
| 4,669,186 | 6/1987 | Liu | 30/125 |
| 4,751,621 | 6/1988 | Jenkins | 362/119 |
| 5,313,376 | 5/1994 | McIntosh | 362/119 |
| 5,315,760 | 5/1994 | Emerson | 30/123 |

*Primary Examiner*—Richard K. Seidel
*Assistant Examiner*—Hwei-Siu Payer
*Attorney, Agent, or Firm*—Abbott Spear

[57] ABSTRACT

The folding knife has a handle provided with a blade support the intermediate part thereof being of less width than the first and second end. A lengthwise slot in the front edge extends through the first end to provide a fork and the bottom of the slot is so spaced from the back edge of the handle to provide a section having a chamber opening through the sides of the section when one of the side covers of the handle is removed. A passageway from the chamber opens through the second end of the blade support and is closed by a lens. A battery and a switch assembly fit in the chamber with the switch assembly provided with a tubular lamp socket which, when the battery and assembly are held by a grounding spring in an operative position extends through the socket. The assembly includes a two part circuit closing push button with one part extending through and held by the back edge of the handle and the other part incorporated in the assembly. The blade is pivotally connected to the fork. Each pair of springs is anchored to a side of the slot to accommodate the blade between them when the knife is closed and each is supported by the blade pivot but is moveable in directions normal thereto and has a lug extending laterally to ride on the cam surfaces of the attached end of the blade.

13 Claims, 3 Drawing Sheets

FOLDING KNIFE PROVIDED WITH AN ACCESSORY

BACKGROUND OF THE INVENTION

Folding or pocket knives are available in sizes ranging from small pen knives to knives provided with a plurality of blades or other tools and to those having blades adapted for heavy duty uses.

The larger knives are commonly carried by those engaged in outdoor activities whether occupational or recreational. Such users often realize that it would be advantageous were their knives provided with flashlights and as far as I am aware, no folding knife has ever been available having a handle in which an accessory such as a miniature flashlight which, when the knife is closed, is between the blade and the back of the handle.

THE PRESENT INVENTION

The general objective of the present invention is to provide a folding pocket knife with a handle of a generally conventional size and shape in which a flashlight or other accessory is incorporated between the blade receiving slot and the back of the handle.

In accordance with the invention, the objective is attained by providing a knife handle having first and second ends with the handle consisting of a blade support including said ends and side walls connected thereto. The blade support is provided with a blade receiving slot extending lengthwise of the front edge of the handle and opening through the first end and so dividing the first end that it functions as a fork in which the attaching end of a blade is pivotally connected thereby enabling the blade to be pivoted between open and closed positions. The length and depth of the slot is such and the blade support is so dimensioned that, when the blade is in its closed position, the cutting edge is within the slot but with the back edge of the blade exposed for digital engagement when the blade is to be swung into its operative position.

The bottom of the slot is spaced from the back edge of the handle to establish an accessory section including the second end of the blade support and dimensioned to enable a chamber to be formed therein with a passageway extending therefrom and opening through the second end and provided with a closure. The chamber opens through at least one and preferably both sides of the section and underlies the side walls.

Most folding knives requires a spring to resiliently oppose the pivoting of the blade between its open and closed positions. In accordance with the invention, one end of one such spring is anchored to one side wall of the slot adjacent the second end of the blade support and the slot is wide enough so that the blade can enter the slot at one side of the spring. The other end of the spring is loosely held by the blade pivot for movement in directions normal with respect thereto. The attaching end of the blade has a cam surface on which a laterally disposed lug of said other spring end rides and by which the spring is held tensioned. At one end of the cam surface there is a stop engaged by the lug when the operative position of the blade is attained and preferably there is a fiat at the other end of the cam surface which when engaged by the lug holds the cutting edge of the blade out of contact with the bottom of the slot as the blade is pivoted into its closed position. In practice, two such springs are employed, each the mirror of the other, and each is anchored to the appropriate side wall of the slot to receive the blade between them when the knife is closed. The lugs of the two springs are disposed towards each other and are dimensioned so that both lugs engage the same part of the cam surface, the stop and the fiat.

The primary use of the accessory section is that of housing a miniature flashlight with the closure at the second end of the handle being a lens. To that end, the chamber accommodates the battery and a housing including a switch assembly, a spring is in resilient contact with the negative end of the battery and urges the battery and also the switch assembly towards the second handle end with the switch housing seated against a shoulder at the junction of the chamber and the passageway and with the positive battery contact then in engagement with the first switch contact of the housing. The switch housing has a tubular socket dimensioned to extend through a central port of the reflector which is in the passageway adjacent the lens. The tubular socket receives the prongs of the lamp and holds one of them against the second switch lead and the other against a ground lead.

An important feature of the invention is that it provides the switch assembly with a push button exposed on the back edge of the knife handle in a shallow depression. In accordance with the invention, the push button consists of two parts of which one is a conductor confined within the housing for limited movement towards and away from the contact and held out of engagement with the contacts by a spring. The other push button part is a non-conductor and has a flanged end dimensioned for engagement with the first part and when seated against the interior surfaces of the chamber enables the assembly to be advanced into or withdrawn from engagement with the shoulder. In practice, the portions of the parts which are mutually engageable are in the case of one part, a conical projection, and in the case of the other part, a complementary recess. Both the battery and the switch housing are insertable into the chamber through whichever side of the chamber is exposed by the removal of its sidewall.

The invention also provides means by which the lamp may be focused as desired. This objective is attained by incorporating a rotatable adjusting annular wheel in the passageway in a position spaced from the reflector. The reflector, held against turning by a resilient O-ring, has a tubular projection dimensioned freely to accommodate the lamp socket and is threaded into the wheel so that, with a side wall of the handle removed, the wheel may be digitally turned in either direction to effect wanted focusing.

Other objectives, novel features and advantages of the invention will be apparent from the following specification, the accompartying drawings and the appended claims.

BRIEF DESCRIPTION OF THE DRAWINGS

The accompartying drawings illustrate a presently preferred embodiment of a folding knife in accordance with the invention in which the accessory is a miniature flashlight

THE PREFERRED EMBODIMENT

Figure 2:
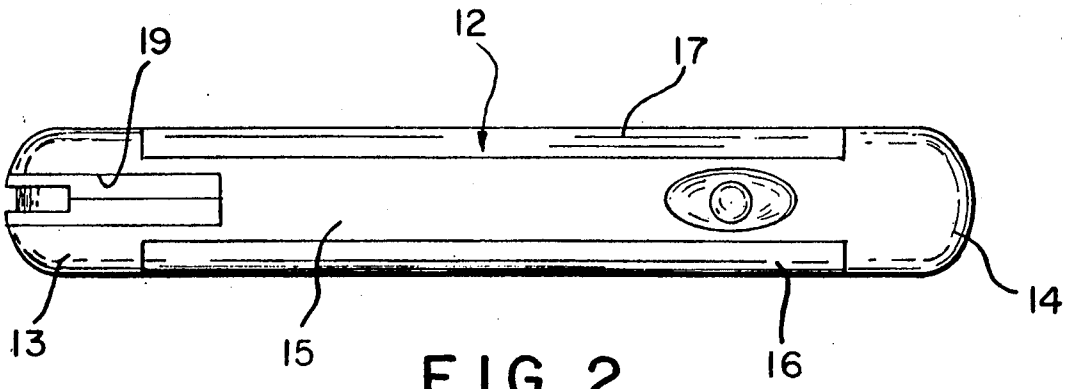
FIG. 2 is a view showing the knife as viewed from the back edge of the handle.
Figure 3:
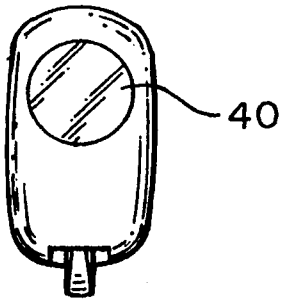
FIG. 3 is a view of the folding knife as seen from the end of the handle in which the lens and reflector of the flashlight are held.

The folding knife illustrated by the drawings has a blade 10 and a handle generally indicated at 11. The handle 11 has a metal blade support, generally indicated at 12, see FIGS. 1 and 2 which has first and second ends 13 and 14, respectively, and a narrower intermediate part 15. Side walls 16 and 17 are detachably secured to the corresponding sides of the intermediate part by screws 18 with the ends of the side walls flush with the corresponding edges of the ends 13 and 14.

Figure 1:
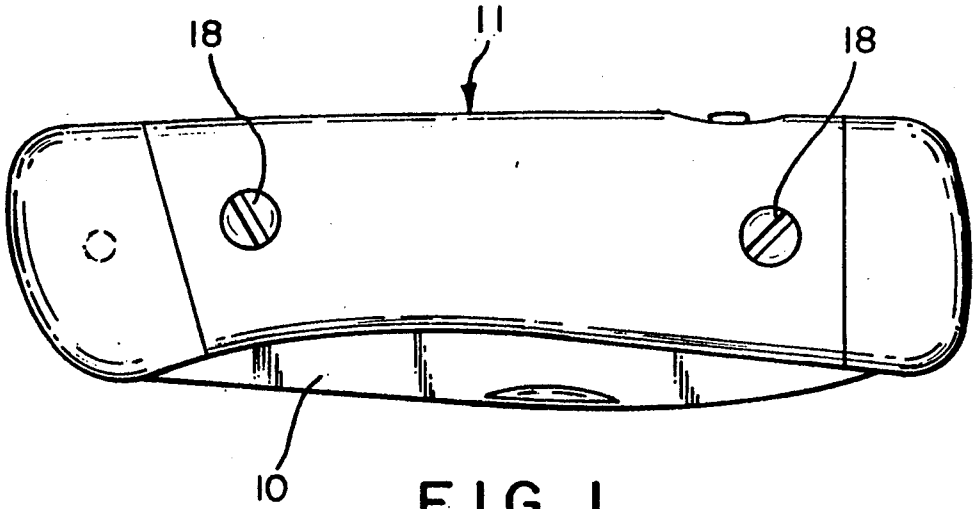
FIG. 1 is a side view of the knife with the blade folded in its closed position.
Figure 4:
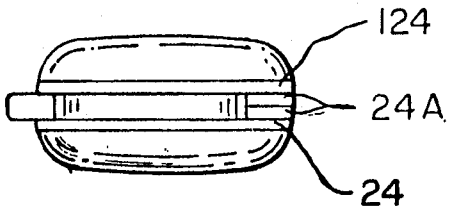
FIG. 4 is a view of the folding knife as seen from the opposite end of the handle.
Figure 5:
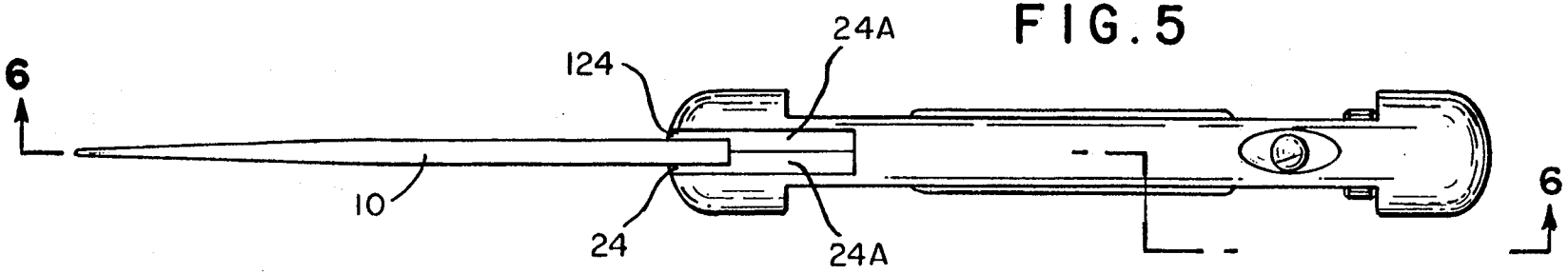
FIG. 5 is a view showing the back edges of the blade and handle with the side walls removed.
Figure 6:
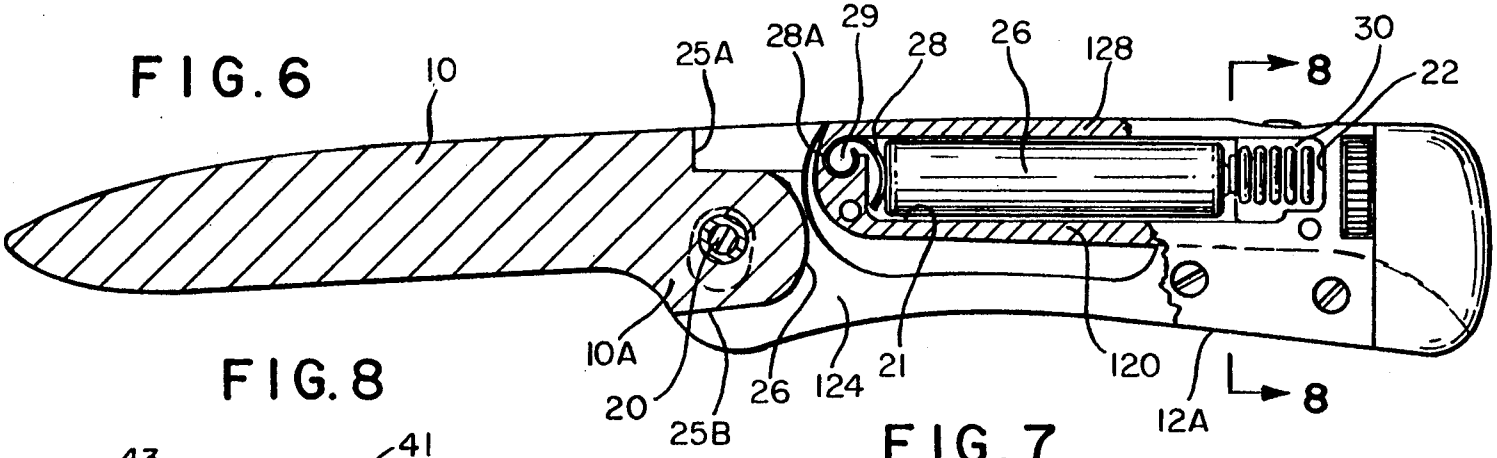
FIG. 6 is a section taken approximately along the indicated line 6—6 of FIG. 5.

The blade support 12 has a lengthwise slot 19 in its front edge 12A, see FIG. 2, extending from its second end 14 through the first end 13 to establish the first end as a fork in which the attaching end 10A of the blade 10 is connected by a bushed pivot 20 enabling the blade 10 to be pivoted between a position of use, see FIGS. 5 and 6, and a closed position, see FIG. 1.

The depth of the slot 19 is such that when the knife is closed, the cutting edge of the blade is conventionally protected with an adequate portion of the remainder of the blade exposed for digital engagement when the knife is to be opened. In accordance with the invention, the depth of the slot 19 is such relative to the back edge 12B of the blade support that a section 12C is provided adequate for the formation therein of an elongated chamber 21 opening through the sides of the blade support 12 and closed by the sides 16 and 17. The chamber 21 has a shoulder 22 at its junction with a passageway 23 opening through the second end 14 of the blade support. The chamber 21 is for flashlight components presently to be described.

In accordance with the present invention, the resilient opposition to the opening and closing of knife is effected with the spring or springs at one or both sides of the blade 10. As shown in the drawings, two springs 24 and 124 are shown with each the mirror image of the other and each has an end anchored to a side of the slot 19 adjacent the second end 14 of the blade support 12 with the springs spaced apart to receive the blade 10 between them when the knife is closed. The other ends of the springs 24 and 124 are loosely held by the pivot 20 with the attaching end 10A of the blade 10 between them.

The attaching end 10A of the blade has a cam surface 25 at one end of which there is a shouldered stop 25A while at the other, there is a flat 25B. Each spring 24, 124 has a laterally disposed lug 24A in engagement with the cam surface 25, its stop 25A or its flat 25B. As shown, both lugs 24A are transversely aligned. As illustrated by FIGS. 5 and 6, in the open position of the knife, the lugs 24A are in engagement with the stop 25 which prevents the blade 10 from pivoting beyond its illustrated position of use with the springs 24 slightly tensioned. As the blade 10 is pivoted towards its closed position, the cam surface 25 is engaged to increase spring tension which remains constant until the lugs 24A of the springs rest on the flat section 25B as the blade reaches its closed position with the cutting edge of the blade yieldably held out of contact with the bottom of the slot 19.

Figure 7:
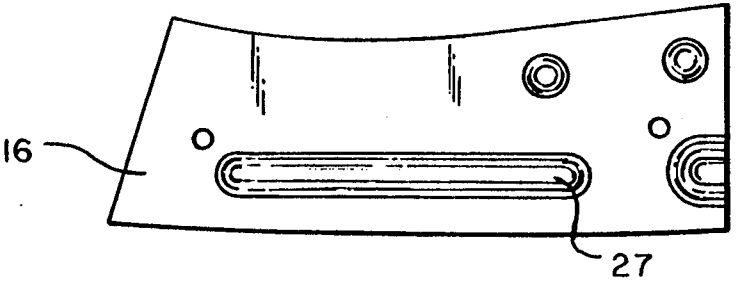
FIG. 7 is a view of the interior surface of one of the side walls.
Figure 8:
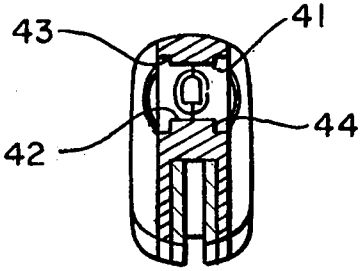
FIG. 8 is a section taken along the indicated line 8—8 of FIG. 6.
Figure 10:
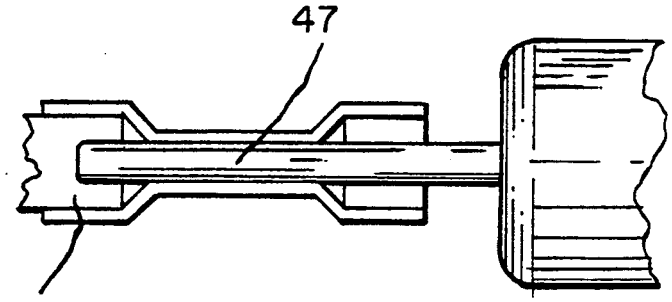
FIG. 10 is a fragmentary view, on a further increase in scale showing one of the resilient contacts of the lamp socket with one of the prongs of the lamp held thereby.

The flashlight battery 26, see FIG. 6, is inserted into the chamber 21 from either side of the blade support and its diameter is slightly greater than the width of the blade support 12. As a consequence each of the side walls 16, and 17 has a shallow recess 27 to accommodate a protruding portion of the battery and hold it in position. As the side walls 16 and 17 are the mirror image of each other, only the recessed surface of the side wall 16 is shown, see FIG. 7.

The negative end of the battery 26 is yieldably engaged by a spring 28 shown as consisting of a curved metal strip having a curled end 28A fitted into and resiliently held by a retaining cavity 29 at the end of the chamber 21 opposite the shoulder 22.

A non-conductive switch housing 30 is a sliding fit in the chamber 21 from either side the chamber 21. The chamber 21 has a port 31 opening through the shallow recess 27 in the back edge 12B of the blade support adjacent the second end 14, see FIGS. 5, 6, 8 and 9. Centrally of the recess 27 there is a port 32 opening into the chamber 21. The housing 30 is pushed by the spring 28 and battery 26 against the shoulder 22 at the junction of the chamber 21 and the passageway 23. The spring pressure also holds the positive contact of the battery against the switch contact 33, see FIG. 9, which extends into a shouldered socket 34 in the housing 30 where it surrounds but does not touch a subjacent compression spring 35.

The housing also has a tubular socket 36 for the lamp 37 with the socket shown as within a metal sleeve 38 and when the housing 30 is in place seated against the shoulder 22 and it extends into the passageway 23 with the lamp 37 extending freely into a reflector 39 in back of a lens 40 which closes the outer end of the passageway 23. The reflector 39 is held against turning by a rubber O-ring engaging the passageway 23. To ensure the correct positioning of the housing 30, the chamber 21 is formed with slideways with one, the slideway 41, on the under surface of the back edge 12B and the other, the slideway 42, on the opposite wall of the chamber 21. The switch housing 30 has guides 43 for engagement with the slideway, 41 and guides 44 for engagement with the slideway 42.

Figure 9:
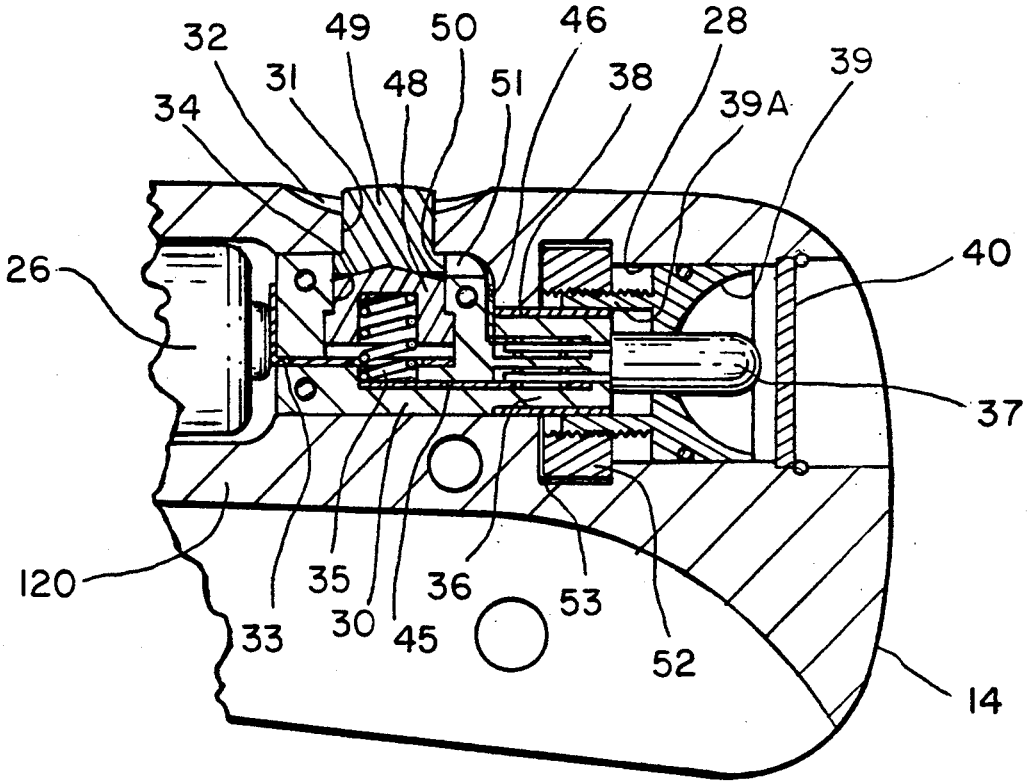
FIG. 9 is a fragmentary lengthwise section on an increase in scale through the flashlight chamber and passageway.

The tubular socket 36 has spaced apart spring contacts 45 and 46 for the prongs 47 of the lamp 37 with the contact 45 extending into the shouldered socket 35 below and spaced from the switch contact 33 and including the spring 35 while the socket contact 46 extends from the lamp socket 36 as shown in FIG. 9, through the socket adjacent the housing 30 and is held by the force of the spring 28 against the shoulder 22.

The switch contacts 33 and 45 are under the control of a two part push button consisting of a flanged conductor 48 as the first part which is yieldably held by the spring 35 above the contact 33 and against the shoulder of the socket 34. The second part of the push button is a plastic actuator 49 formed with a flange 50 engageable with the under surface of the back edge 12B surrounding the port 31 through which the actuator extends but from which it does not protrude. As shown in FIG. 9, the flange 50, exposed in the chamber 21, is dimensioned for entry into the open end of the shouldered socket 34 thereto along with the conductor 48. When the actuator 49 is digitally depressed to bring the conductor 48 against the switch contact 33 against the resistance of the spring 35, the battery circuit is closed to the lamp 37. As the flange 50 is exposed in the chamber 21, the housing 30 has a shallow channel 51 extending towards the shoulder 22 and is receptive of the flange 50 as the switch housing 30 is being seated against the shoulder 22. It will be noted that of the mutually engageable surfaces of the two parts of the push button, one has a conical depression to receive a complementary projection of the other.

Another feature of the invention is that the reflector 39 is adjustable relative to the lamp 37. To that end, an annular wheel 52 is held captive in an annular channel 53 in the passageway 23 adjacent the shoulder 22. The reflector 39 has a tubular extension 39A which is threaded into the adjusting wheel 52 whereby with either or both side walls 16, 17 removed, by turning the adjusting wheel in one direction or the other, the reflector 39 is moved axially until a wanted focus is attained.

It should be noted that the front edge of the handle is slightly concave and that the grip will be the same whether the knife or the flashlight is to be foremost. It is also important to note that it is practically impossible to turn the flashlight on when the handle 11 is gripped to employ the knife.

I claim:

1. A combined folding knife and accessory including a handle provided with a blade and accessory support having first and second ends and an intermediate portion narrower than said ends, first and second sides, front and back edges and a lengthwise slot opening through the front edge and so dividing the first end as to establish a fork, side walls connected to the sides of the intermediate portion, the bottom of the slot spaced from the back edge to provide an intermediate section having a chamber having a passageway opening through the second end, an accessory in the chamber and provided with a movable actuator exposed in said back edge and operable to effect the use of the accessory, a blade having a cutting edge a back edge and an attaching end, said attaching end within the fork, a pivot connecting the attaching end to the fork, said blade shaped and dimensioned to fit in the slot with the back edge of the blade exposed for digital engagement in a closed position of the blade, and at least one spring having first and second ends, the first end of the spring anchored in the slot adjacent the second end of the handle and the second end of the spring held by the pivot for limited movement in directions normal to the axis of the pivot, said spring provided with an offset lug engaging the periphery of the attaching end of the blade and providing resilient resistance to the pivoting of the blade from said closed position into an open, operative position thereof, and said periphery provided with a shoulder engageable as a stop by the lug when the blade has been pivoted into said operative position.

2. The combined folding knife and accessory of claim 1 wherein said at least one spring comprises two springs, each the mirror image of the other and anchored to the side of the slot opposite the other, and the two springs are spaced apart and dimensioned to accommodate the blade between them.

3. The combined folding knife and accessory of claim 1 in which the periphery of the attaching end of the blade is a cam surface provided at one end with said shoulder and a flat at the other end, the flat engaged by the lug as the blade enters its closed position then to yieldably hold the cutting edge of the blade out of contact with the bottom of the slot.

4. The combined folding knife and accessory of claim 1 in which the front edge of the handle is arcuate between the first and second ends so that the same manual grip results whichever of said first and second end is foremost.

5. The combined folding knife and accessory of claim 1 in which the back edge of the handle has a recess adjacent the second end and the movable actuator is within the recess and does not protrude therefrom so as not to be engaged and moved unless the second end is manually held to be foremost in use.

6. The combined folding knife and accessory of claim 1 in which the chamber opens through at least one side thereof, and is dimensioned to enable the accessory to be inserted into the chamber from said one side when an appropriate one of the side walls has been removed.

7. The combined folding knife and accessory of claim 6 in which the accessory is a miniature flashlight comprising a battery, a non-conductive switch housing having a tubular socket, a lamp having two prongs seated in the tubular socket, a reflector and a lens, the chamber has a shoulder at the junction of the passageway therewith, the lens closes the passageway, and the reflector is held in the passageway close to the lens, the battery and the switch housing are within the chamber and slidable lengthwise thereof, a grounded spring in said chamber urges the battery and switch housing into a position in which the switch housing is seated against the shoulder, an actuator, the switch housing has a shouldered socket receptive of the actuator and opening through the back edge of the handle exposing the actuator when the switch housing is seated against the shoulder, first and second switch contacts adjacent the one end of the shouldered socket, a spring in said one end constitutes a part of the first switch contact and the first switch contact extends into the tubular socket into engagement with one prong of the lamp, the second switch contact has an end against which the positive terminal of the battery is held by the grounded spring, the tubular socket is engaged by the other lamp probe and has an end held by the switch housing against the shoulder and a switch element includes said actuator and is within the shouldered socket and is held by the grounded spring therein against the shoulder thereto but is movable relative thereto to bring the switch element into contact with the second switch contact.

8. The combined folding knife and accessory of claim 7 in which the end of the chamber remote from the shoulder has a cavity, the grounded spring in the chamber is a curved metal strip having a curled end fitted in and resiliently held in the cavity.

9. The combined folding knife and accessory of claim 7 in which a rotatable annular focusing wheel is held captive in the passageway, the reflector has a tubular sleeve threaded through the wheel, rotation of the wheel in either direction moving the reflector axially with respect to the lamp and the periphery of the wheel is exposed for digital engagement when one of said side walls is removed.

10. The combined folding knife and accessory of claim 7 in which the switch element and the actuator are separate components of a two part push button, the actuator has a flange engageable with the inner surface of the chamber and the switch element has an end exposed in a proximate end of the shouldered socket engageable by the flange of the actuator when the switch housing is seated against the shoulder with said proximate end axially aligned with the actuator.

11. The folding knife and accessory of claim 10 in which the switch housing has a shallow channel extending from the open end of the shouldered socket through the end of the housing which is to engage the shoulder of the chamber, the shallow channel of a width and depth to slidably accommodate the flange of the actuator as the switch housing is slid into contact with said shoulder.

12. The combined folding knife and accessory of claim 10 in which the end of the actuator which is engageable with the switch element is a conical depression and the engaged end of the switch element is a mating conical projection.

13. The combined folding knife and accessory of claim 7 in which the walls of the chamber have slideways adjacent the shoulder at the junction of the chamber and the passageway and the switch housing has marginal guides slidably engageable with the slideways to ensure that when the switch housing is seated against said shoulder, the open end of the shouldered socket thereof is axially aligned with the actuator.

* * * * *